US009502021B1

(12) United States Patent
Kleijn

(10) Patent No.: US 9,502,021 B1
(45) Date of Patent: Nov. 22, 2016

(54) METHODS AND SYSTEMS FOR ROBUST BEAMFORMING

(71) Applicant: GOOGLE INC., Mountain View, CA (US)

(72) Inventor: Willem Bastiaan Kleijn, Lower Hutt (NZ)

(73) Assignee: Google Inc., Mountain View, CA (US)

( * ) Notice: Subject to any disclaimer, the term of this patent is extended or adjusted under 35 U.S.C. 154(b) by 105 days.

(21) Appl. No.: 14/510,838

(22) Filed: Oct. 9, 2014

(51) Int. Cl.
*G10K 11/175* (2006.01)

(52) U.S. Cl.
CPC ..... *G10K 11/175* (2013.01)

(58) Field of Classification Search
None
See application file for complete search history.

(56) References Cited

U.S. PATENT DOCUMENTS

| | | | | |
|---|---|---|---|---|
| 7,171,008 | B2 | 1/2007 | Elko | |
| 8,130,979 | B2 | 3/2012 | Harney et al. | |
| 8,270,634 | B2 | 9/2012 | Harney et al. | |
| 2008/0240463 | A1* | 10/2008 | Florencio | H04R 3/005 381/92 |
| 2009/0175466 | A1 | 7/2009 | Elko et al. | |
| 2010/0202628 | A1 | 8/2010 | Meyer et al. | |
| 2011/0194719 | A1 | 8/2011 | Frater | |
| 2012/0243698 | A1 | 9/2012 | Elko et al. | |
| 2013/0083943 | A1* | 4/2013 | Sorensen | H04R 3/005 381/92 |
| 2013/0142355 | A1 | 6/2013 | Isaac et al. | |
| 2014/0177868 | A1* | 6/2014 | Jensen | H04R 3/002 381/94.7 |
| 2014/0307654 | A1* | 10/2014 | Kim | H04B 7/0617 370/329 |
| 2014/0372129 | A1* | 12/2014 | Tzirkel-Hancock | H04R 3/005 704/278 |

OTHER PUBLICATIONS

Adel Hidri et al., "About Multichannel Speech Signal Extraction and Separation Techniques," Journal of Signal and Information Processing, 2012, No. 3, pp. 238-247 (May 2012).

Adel Hidri et al., "Beamforming Techniques for Multicultural Audio Signal Separation," JDCTA: International Journal of Digital Content Technology and its Applications, vol. 6, No. 22, pp. 659-667 (Dec. 25, 2012).

* cited by examiner

*Primary Examiner* — Peter Vincent Agustin
(74) *Attorney, Agent, or Firm* — Brake Hughes Bellermann LLP

(57) ABSTRACT

Provided are methods and systems for spatially selecting acoustic sources using a post-processor that consists of a selection of one postfilter from a set of postfilters, or a cascade of postfilters, where each postfilter is optimal for a particular scenario. Each postfilter individually is based on optimizing the gain for each time-frequency bin based on knowledge of (i) a spatial covariance matrix for the desired source, (ii) a spatial covariance matrix for the interfering sources, and (iii) microphone signals in some neighborhood of the current time-frequency bin.

23 Claims, 9 Drawing Sheets

METHODS AND SYSTEMS FOR ROBUST BEAMFORMING

BACKGROUND

Selection between audio sources in space (e.g., talkers, musical instruments, etc.) is often performed with beamformers. Many conventional beamformers have a linear processing structure. These existing systems have a three-way tradeoff between (1) hardware size/complexity (e.g., number of microphones), (2) performance, and (3) robustness. Robustness is about graceful degradation with increasing error in the spatial configuration of the desired and interfering acoustic sources. It is very difficult to achieve robustness and good performance with a small number of microphones, and is even a challenge to achieve robustness with a large number of microphones. These problems are a direct result of the mathematical structure of the beamformers.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

The present disclosure generally relates to methods and systems for signal processing. More specifically, aspects of the present disclosure relate to spatially selecting acoustic sources using a nonlinear post-processor.

One embodiment of the present disclosure relates to a system comprising at least one processor and a computer-readable medium coupled to the at least one processor having instructions stored thereon which, when executed by the at least one processor, causes the at least one processor to, for one or more coefficients characterizing an output signal: select a desired-source scenario from a set of predefined desired-source scenarios to maximize the amplitude of the output signal, and select an interference scenario from a set of predefined interference scenarios to minimize the amplitude of the output signal, wherein the selected desired-source scenario and the selected interference scenario govern the operation of the at least one processor, and wherein the output signal corresponding to the selected scenario pair is used as the processor output signal.

In another embodiment, the at least one processor of the system is further caused to select the desired-source scenario based on sensor input signals and quantitative predefined scenario descriptions.

In another embodiment, the at least one processor of the system is further caused to select the interference scenario based on sensor input signals and quantitative predefined scenario descriptions.

In yet another embodiment, the at least one processor of the system is further caused to select the desired-source scenario based on sensor input signals and adaptable predefined scenario descriptions.

In still another embodiment, the at least one processor of the system is further caused to select the interference scenario based on sensor input signals and adaptable predefined scenario descriptions.

Another embodiment of the present disclosure relates to a computer-implemented method comprising: for one or more coefficients characterizing an output signal, selecting a desired-source scenario from a set of predefined desired-source scenarios, and selecting an interference scenario from a set of predefined interference scenarios, wherein the desired-source scenario is selected to maximize the amplitude of the output signal and the interference scenario is selected to minimize the amplitude of the output signal, based on sensor input signals and quantitative predefined scenario descriptions, and wherein the output signal corresponding to the selected scenario pair is used as the processor output signal.

Another embodiment of the present disclosure relates to a system comprising at least one processor and a computer-readable medium coupled to the at least one processor having instructions stored thereon which, when executed by the at least one processor, causes the at least one processor to, for one or more coefficients characterizing an output signal: combine a plurality of numbers, each number being a gain associated with a unique pair of a desired-source scenario selected from a set of predefined desired-source scenarios, and an interference scenario selected from a set of predefined interference scenarios, wherein the plurality of numbers are combined such that the resulting number approaches a largest desired-source scenario number and a smallest interference scenario number, and wherein the resulting number is used to multiply said coefficients to render new coefficients characterizing a new output signal.

In another embodiment, the at least one processor of the system is further caused to mask interference of the desired source signal based on the combined plurality of numbers.

Another embodiment of the present disclosure relates to a computer-implemented method comprising: multiplying a time-frequency coefficient by a real number, the time-frequency coefficient being part of a representation of a beamformer output signal or a single microphone output signal, wherein the real number is based on a predefined spatial covariance matrix of a desired source, a predefined covariance matrix for an interferer, a preceding beamformer, and a beamformer input for the time-frequency coefficient.

Another embodiment of the present disclosure relates to a system comprising at least one processor and a computer-readable medium coupled to the at least one processor having instructions stored thereon which, when executed by the at least one processor, causes the at least one processor to multiply a time-frequency coefficient that forms a component of a representation of a beamformer output signal or a single microphone output signal by a real number that minimizes the squared difference between a resulting scaled coefficient and a desired-source signal, the desired-source signal being adjusted to compensate for the desired-source signal traveling from a location of the source to a location of the beamformer or the single microphone.

In one or more other embodiments, the methods and systems described herein may optionally include one or more of the following additional features: the quantitative predefined scenario descriptions are covariance matrices; the set of predefined interference scenarios include at least one interference scenario and a reflection of the at least one interference scenario around 0 degrees; the set of predefined desired-source scenarios represent angles over a range spanning a desired beamwidth; the adaptable predefined scenario descriptions are covariance matrices; the desired-source scenario is selected to maximize the amplitude of the output signal based on sensor input signals and adaptable predefined scenario descriptions; the interference scenario is selected to minimize the amplitude of the output signal based on sensor input signals and adaptable predefined scenario descriptions; the real number is further based on beamformer input for other coefficients in the time-frequency neighborhood of the time-frequency coefficient; and/or the adjustment to the desired-source signal is further based on compensating for successive processing by the beamformer.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
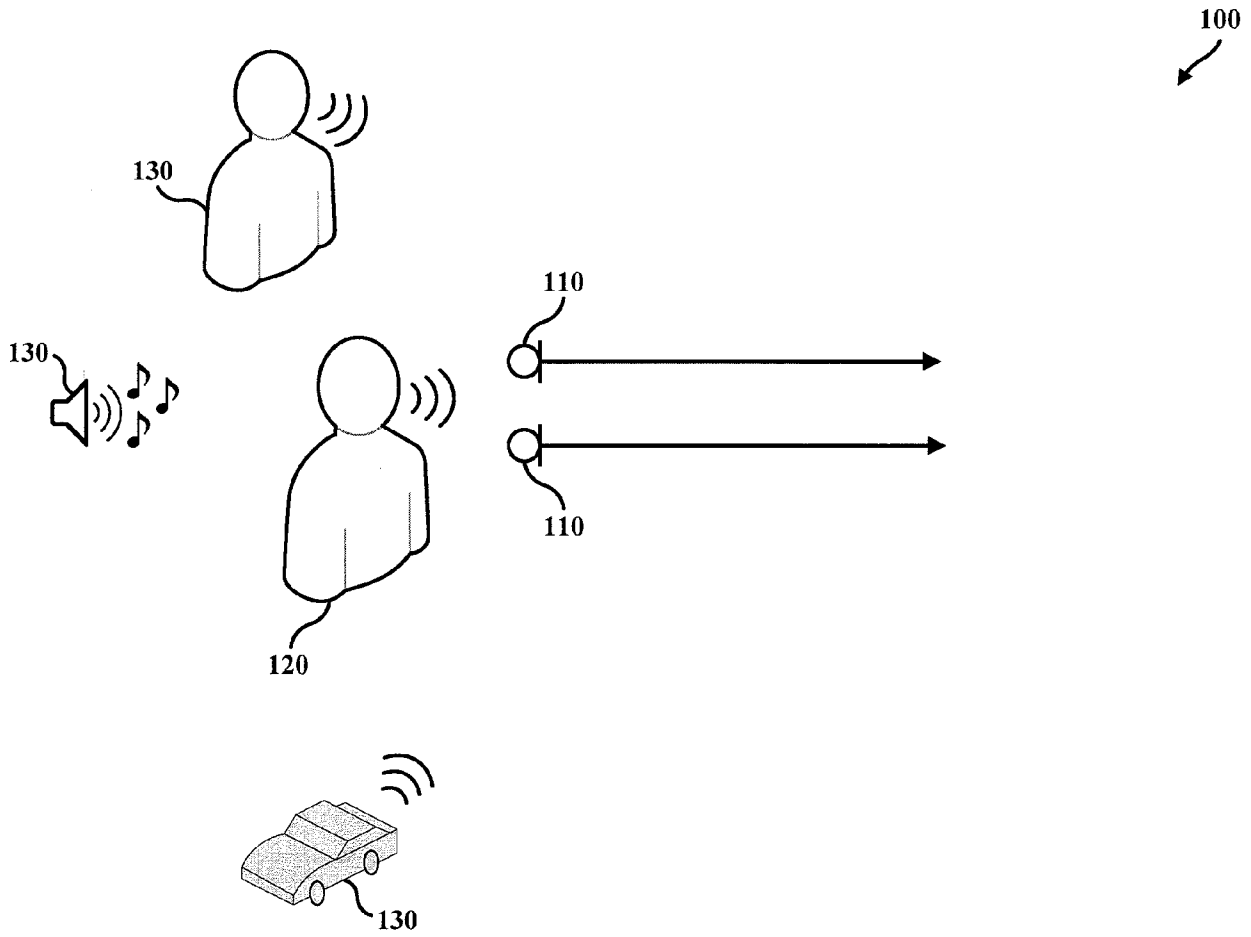
FIG. 1 is a schematic diagram illustrating an example application for a postfilter for beamforming according to one or more embodiments described herein.

The headings provided herein are for convenience only and do not necessarily affect the scope or meaning of what is claimed in the present disclosure.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Overview

Various examples and embodiments will now be described. The following description provides specific details for a thorough understanding and enabling description of these examples. One skilled in the relevant art will understand, however, that one or more embodiments described herein may be practiced without many of these details. Likewise, one skilled in the relevant art will also understand that one or more embodiments of the present disclosure can include many other obvious features not described in detail herein. Additionally, some well-known structures or functions may not be shown or described in detail below, so as to avoid unnecessarily obscuring the relevant description.

As described above, beamformers aim to select acoustic sources that are spatially distinct. When the number of microphones of a beamformer is small, the beamformer's spatial selectivity is poor, and with a large number of microphones robustness to deviations in the source locations is often difficult to achieve. From another perspective, using many microphones generally results in very narrow peaks in the angular response (so if the angle is wrong, the performance is all wrong), and using few microphones results in very low performance (e.g., inaudible improvement). If using techniques that optimize some criterion, then performance with few microphones can be good, but again robustness is a problem (e.g., enormous gains result for spatial signal components that are implicitly assumed not to be present).

Accordingly, the methods and systems of the present disclosure are designed to alleviate the problems described above by (i) using a set of postfilters rather than a single postfilter, and (ii) using a new structure for the individual postfilters. As will be described in greater detail below, each postfilter provides an optimal real gain in the squared-error sense for each time-frequency bin for a particular acoustic scenario. In accordance with one or more embodiments, the postfilters may be based on knowledge of a spatial covariance matrix of the desired source, a spatial covariance matrix of the interfering sources, and microphone signals in some neighborhood of the time-frequency bin. In such embodiments, the spatial covariance matrices characterize the acoustic scenario. As described in the present disclosure, it is advantageous to separate the desired-source scenario (which may be specified by a desired-source covariance matrix) and an interfering sources scenario (which may be specified by the interfering sources covariance matrix).

The postfilters that are optimal for each scenario in an applicable set of desired-source and interference scenarios may then be used to render a combined postprocessor that can consist of a cascade of postfilters or an adaptively selected postfilter. Among numerous other advantages and improvements over existing approaches, the resulting system provides excellent performance for a two-microphone system even when the precise desired source and interference scenarios are unknown.

The methods and systems of the present disclosure have numerous real-world applications. At least one reason for this is because the beamformer/postfilter system described herein has a more favorable performance versus robustness versus hardware complexity trade-off than existing beamformers have. Instead, the beamformer/postfilter provides excellent performance in real-world circumstances, and it does so at a low hardware cost. For example, the methods and systems may be implemented in computing devices (e.g., laptop computers, desktop computers, etc.) to remove interfering audio sources in the background from the user sitting in front of the device and, for example, speaking into a microphone built into the device. FIG. 1 illustrates an example 100 of such an application, where a user 120 is positioned in front of at least one audio capture device 110 (e.g., microphone) and there are interfering audio sources 130 in the background. In another example, the methods and systems of the present disclosure may be used in mobile devices (e.g., mobile telephones, smartphones, personal digital assistants (PDAs)) and in various systems designed to control devices by means of speech recognition.

Beamforming is a well-established technique for enhancing audio sources that use multiple microphones. The basic approach to beamforming is a linear setup where each microphone signal is filtered with a linear filter and the results are summed. The aim under such existing approaches is that the filtered signals add coherently for a source signal originating from a preferred location and cancel for interfering signals originating from other locations. While the performance of such linear beamformers may be good in simulated scenarios, their performance is often unsatisfactory in real-world scenarios.

The common occurrence of inadequate performance of many existing beamforming techniques is a natural result of the processing and physical array structures. In general, the rejection of interferers improves by increasing the number of elements (at constant element spacing). However, with an increasing number of microphones the directional sensitivity generally increases as well. In other words, the peaks in the beamformer gain as a function of location (e.g., angle for far-field scenarios) become narrower. As a result, minor errors in assumed source location can lead to a dramatic decrease in performance for large array sizes.

The lack of robustness in many existing beamforming approaches is generally most severe for straightforward optimal procedures such as, for example, the minimum variance distortionless response (MVDR) method or the related multichannel Wiener filter. In such cases, the low robustness is a direct consequence of exploiting the design criteria more effectively. While some more recent approaches reduce beamformer robustness problems by explicitly accounting for the uncertainty in location of the desired and interfering sources, these existing systems generally require a large number of microphones for good performance.

In view of these difficulties encountered with existing approaches, the methods and systems of the present disclosure are designed to use a less constrained paradigm to obtain good and robust beamforming performance.

It is possible to enhance beamformers by imposing a condition on the signals. To this purpose, the signal may first be decomposed into coefficients representing time-frequency bins. A condition may then be imposed that the signal in a particular time-frequency bin arrives from either the desired source or from one or more interfering sources. If the incoming signal satisfies this condition, then a "gate" operator may be used to reduce interference to zero and allow the desired signal through.

In a practical situation, the condition that the signal in a particular time-frequency bin originates from the desired source or interference cannot be imposed on the signal. Instead, it may be assumed that this condition holds. The assumption is often a good approximation, accommodated by the fact that natural sounds, including speech, have a large dynamic range. As a result, in most practical situations a particular source will dominate in a particular time-frequency bin. The remaining question is then: what is the optimal gate operator for a particular scenario?

To answer the question of what the optimal gate operator is, it may be implemented as an adaptive scalar multiplicative gain. The goal is then to compute the optimal gain according to some criterion. In accordance with one or more embodiments of the present disclosure, the squared error of the desired source may be used as the criterion.

A gate operator can be optimized for a particular hypothesized scenario and observation. It should be noted that it is beneficial to consider a set of possible scenarios, assuming they are sufficiently similar, rather than just one scenario. It is possible to create a better gate operator by combining the effect of the operators for each scenario. Each scenario can be separated into a desired-source scenario and an interferer scenario. In accordance with one or more embodiments described herein, the method and system of the present disclosure simply selects the most open gate from the possible desired-source scenarios and the most closed gate from the interferer scenarios. As will be further described below, the order of these two selection operations generally is of minor importance, but can be chosen for best performance for a particular application.

In a general sense, the postfilter of the present disclosure applies a particular gain to each of the coefficients of a suitable basis or frame (e.g., a generalized basis) expansion of the signals. Because the angular response of an array changes with frequency, it is natural to choose a time-frequency basis or frame. The Gabor transform is an example of such a representation. The gains may be thought of as resulting from a belief about the proportion of the desired source and interfering sources in the particular coefficient. The belief is based on the spatial correlation of the coefficients representing the microphone signals. Coefficients characterizing time-frequency components for which the desired signal is believed to dominate are provided with a high gain. Coefficients that are believed to describe interfering sources receive a low gain.

Theory

As will be described in greater detail below, the methods and systems of the present disclosure are designed to estimate, from a set of microphone signals, a desired source signal. In accordance with at least one embodiment, this estimate may be obtained (e.g., generated, determined, derived, calculated, etc.) with a conventional beamformer followed by an adaptive postfilter that multiplies each time-frequency bin with an optimal real-valued gain.

The following provides details about (a) the notation used in various equations and expressions presented to aid in understanding the features and embodiments of the present disclosure, (b) how to deal with the uncertainty in the scenario, (c) the formulation of the optimization problem, (d) the general solution to the problem, and (e) example solutions for specific scenarios. Because the solutions operate separately for each frequency, the following also describes how additional improvements can be made by accounting for dependencies between frequency bands.

It should also be noted that the following uses the general near-field formulation that makes no assumptions about the location of the desired sources and interfering sources. In addition, far-field cases are generally considered for specific scenarios.

A. Notation

In describing various embodiments and features of the methods and systems of the present disclosure, a discrete-time formulation is used and the symbol $i \in Z$ is used as the time index. For processes, subscripts are used to label the time samples. In general, the samples utilized in the following description are those of a time-frequency representation for a particular frequency channel.

Random variables and vectors are denoted by capital letters, and the corresponding realizations of those processes are denoted by the corresponding lower-case letters. Hermitian transposes are denoted by $^H$.

The microphone observations form an M-dimensional complex stochastic vector process Y. The notation Y is short for $\{Y_i\}_{i\in\mathbb{Z}}$. The realization of a time sample of the microphone vector is written as $y_i \in C^M$.

The realization of the desired source signal is denoted by $\xi_i \in C$. While the signal $\xi_i$ is the realization of a random process, the goal is to estimate the realization $\xi_i$, and thus the corresponding random variable is not used. However, the microphone signals and the interfering signals are considered as random processes.

A matrix norm $\|\cdot\|_\alpha$ convenient for the present purpose is defined:

$$\|R_\beta\|_\alpha = \{v^H R_\beta v, v = \operatorname{argmax}_w w^H R_\alpha w, w^H w = 1\} \tag{1}$$

and the following is written:

$$\overline{R}_\alpha = \frac{1}{\|R_\alpha\|_\alpha} R_\alpha. \tag{2}$$

B. Handling a Range of Scenarios

Figure 2:
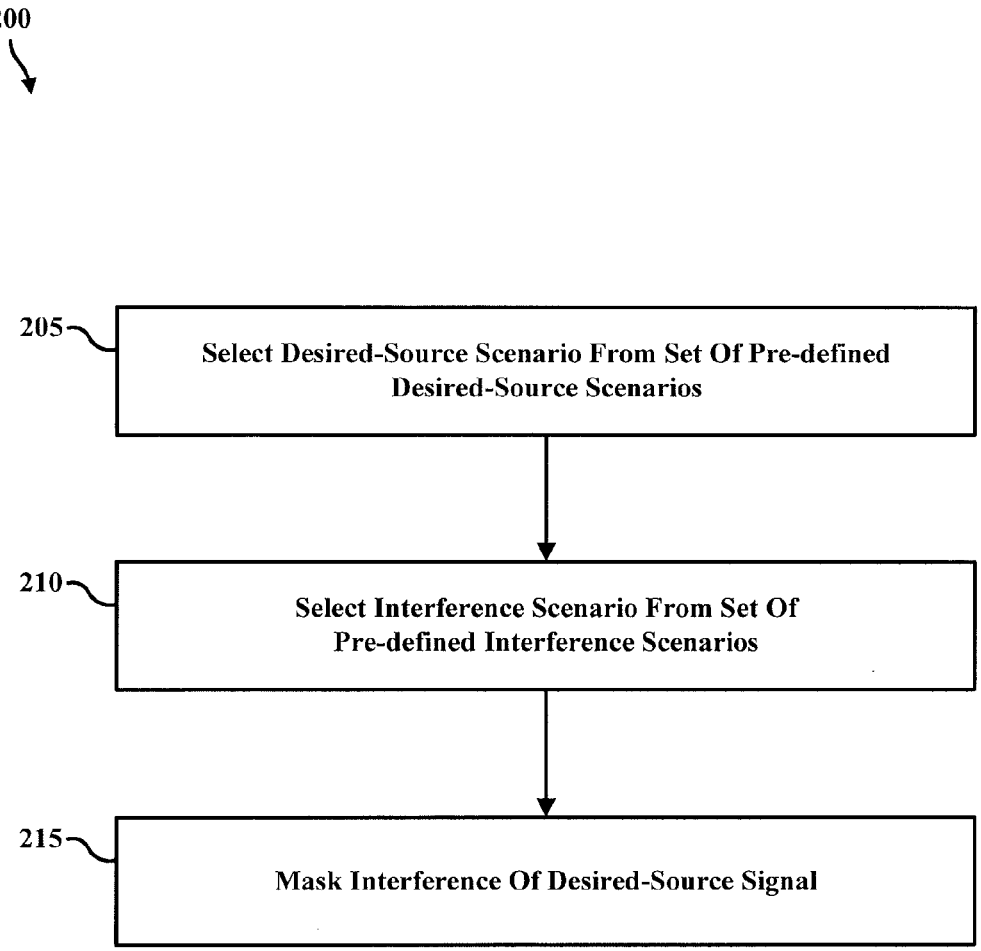
FIG. 2 is flowchart illustrating an example method for selecting desired-source and interference scenarios for masking interference of a desired-source signal according to one or more embodiments described herein.

The scenario that a beamformer operates in is generally not known with certainty and may change over time (with i). For convenience, the following considers a countable set of scenarios and separates the scenarios for the desired source and the interference (it should be noted that the principles do not change for continuous sets). FIG. 2 illustrates an example high-level process 200 for selecting a desired-source scenario and an interference scenario for the purpose of masking the interference of a desired-source signal. The details of blocks 205-215 in the example process 200 will be further described in the following.

Let $d_n$ label the n'th scenario for the desired source and $u_m$ label the m'th interference scenario. Furthermore, let $\eta(y_i, d_n, u_m, d_n', u_m')$ denote the distortion in the desired source signal that occurs if the observation is $y_i$, the actual scenario pair is $(d_n, u_m)$ and beamformer is optimized for the pair $(d_n', u_n')$. Assuming the desired source scenario and the interference scenario are independent, the expected distortion can be written as $$\eta(y_i) = \sum_{n,n',m,m'} \eta(y_i, d_n, u_m, d_{n'}, u_{m'}) p(d_{n'} \mid y_i, d_n) p(d_{m'} \mid y_i, d_m) p(d_n) p(d_m) \tag{3}$$

where $p(d_{n'} | y_i, d_n)$ is the probability that was optimized for scenario $d_{n'}$ when the actual scenario is $d_n$ and $p(u_{m'} | y_i, u_m)$ is the probability that was optimized for $u_{m'}$ when $u_m$ occurred, both with observation $y_i$. It is most straightforward to make these decisions deterministically, which means that the conditional probabilities are indicator functions that take the value 0 or 1.

It is self-evident that $$\eta(y_i, d_n, u_m, d_n', u_m') \geq \eta(y_i, d_n, u_m, d_n, u_m) \tag{4}$$

and that one of the goals for the method and system of the present disclosure is to minimize $p(d_{n'} | y_i, d_n)$ for $n' \neq n$ and minimize $p(u_{m'} | y_i, u_m)$ for $m' \neq m$. In other words, the method and system aims to identify the scenarios correctly.

An effective and simple strategy for the selection of the scenarios can be based on equation (4). In general, the best-choice interference scenario is expected to result in the strongest interference suppression and the best-choice desired-source scenario is expected to result in the lowest desired-signal suppression. Thus, let $g_{in'm'}$ be the non-negative, real postprocessor gain obtained for the observation at time i and assumed scenario pair $(d_{n'}, u_{m'})$. Then a reasonable gain selection is $$g_i = \max_{n'} \min_{m'} g_{in'm'}, \tag{5}$$

where the operation order in this instance was chosen to favor suppression. In a different situation it may be appropriate to favor transparency, which would reverse the order shown in equation (5) above.

In practice it may be advantageous to approximate equation (5) by $$g_i = 1 - \prod_{n'} \left(1 - \prod_{m'} g_{n'm'}\right). \tag{6}$$

If there is only one desired-source scenario, then equation (6) corresponds to a concatenation of the postfilters corresponding to different interference scenarios. While equations (5) and (6) describe effective methods, they are not guaranteed to be optimal. However, the description that follows illustrates that the postfilter of the present disclosure provides state-of-the-art performance.

C. Formulation of Postfilter for Specific Scenario

The following considers the computation of the postfilter for a particular desired-source and interferer scenario pair $(d_n, u_m)$. The desired source signal may be considered to be a signal $\xi_i$ generated coherently over a region characterized by the aperture function $f_n$: $R^3 \to R$, where n labels the scenario. Particularly at low frequencies, the aperture function $f_n$ is naturally modeled as a Dirac delta function. The interferer is described by a signal density $s_{im}$: $R^3 \to R$ that is the realization of the random field $S_{im}(x)$, where m labels the scenario. For purposes of brevity and simplicity, the following description omits the scenario labels m and n.

It may be assumed that the response of a microphone to a source signal is obtained by multiplying the source signal with a complex factor. The realization of the microphone vector process may then be written as $$y_i = \int_{\mathbb{R}^3} h(x) s_i(x) dx + \int_{\mathbb{R}^3} h(x) f(x) dx \xi_i. \tag{7}$$

where h: $R^3 \to C^M$ is the microphone vector response to a sound impulse at a particular location in space and $x \in R^3$ is spatial location.

The relation of equation (7) is a good approximation if the signals are frequency channels of a Gabor frame representation, assuming the Gabor frame has a resolution selected to make the difference between linear and circular convolution for computing acoustic responses negligible. This implies that the frame functions must have sufficiently large support. The following will not make explicit the dependencies on the center-frequencies of the channels.

A linear beamformer takes the vector output of equation (7) and produces a scalar estimate of the desired source signal $\xi_i$ by performing an inner product (which is sometimes considered a "weighting") with the vector $w \in C^{\mathcal{M}}$:

$$\phi_i = \omega^H y_i, \tag{8}$$

where $\phi_i$ is the estimate of the desired signal $\xi_i$. It should be noted that, generally, the relative scaling of $\phi$ and $\xi$ is less important for the purpose of beamforming. In the present context $\omega$ may be considered to be time-invariant, but naturally it usually is adapted to the scenario.

The postprocessor in accordance with one or more embodiments described herein applies a postfilter gain $g_i \in R$ to the output of the beamformer. The estimate of the desired source signal is the random variable $$\begin{aligned}\hat{\Phi} &= g_i \Phi_i \\ &= g_i w^H Y_i \\ &= g_i w^H \int h(x) S_i(x) dx + g_i w^H \int h(x) f(x) dx \xi_i.\end{aligned} \tag{9}$$

In accordance with one or more embodiments of the present disclosure, the aim is to determine $g_i^*$, the gain $g_i$ that minimizes a suitable criterion, given only knowledge of the observed microphone vector signal y, the aperture $f$ of the desired source, and the variance density of $S_i(x)$. The gain is to be optimized over a suitable time (and frequency) window operator, which is associated with a time-dependent averaging operator $A_i$. In practice, the operator $A_i$ can be, for example, an averaging over a window of designated length (e.g., it can generally be expected that an averaging over 20 milliseconds (ms) will be a good estimator for the estimation of a speech signal).

To find the optimal real-valued gain g*, it is natural to use a criterion that accounts for phase differences and also normalizes for the gain of the spatial response and beamformer:

$$g_i^* = \underset{g}{\operatorname{argmin}} E\left[A_i\left[|w^H h_\xi \xi - g\Phi|^2\right]\right], \tag{10}$$

where E is the (ensemble) expectation over the random interfering field $S_i(x)$, and where the definition $h_\xi = \int h(x) f(x)\, dx$ is used to simplify notation. It should be noted that E does not average over the desired source signal $\xi_i$; it averages only over the contexts $\xi_i$. It should also be noted that no stationarity assumptions are made.

The optimal gain can be rewritten as $$\begin{aligned}g_i^* &= \underset{g}{\operatorname{argmin}} E\left[A_i\left[|w^H h_\xi \xi - g\Phi|^2\right]\right] \\ &= \underset{g}{\operatorname{argmin}} E[A_i[g^2|\Phi|^2 - g w^H h_\xi \xi \Phi^H - g h_\xi^H w \xi^H \Phi]].\end{aligned} \tag{11}$$

Let a window be selected such that $E[A_i[\xi \int_{R^3} h^H(x) S(x)\, dx]] \approx 0$ (it should be noted again that E does not average over $\xi$). As will be further described below, in accordance with at least one embodiment, the accuracy of the present approach can be improved if the ensemble averaging is not essential, that is if $A_i[\xi \int_{R^3} h^H(x) s(x)\, dx] \approx 0$. Equation (11) may be simplified to $$\begin{aligned}g_i^* &= \underset{g}{\operatorname{argmin}} E\left[A_i\left[g^2|\Phi|^2 - g|w^H h_\xi|^2 |\xi|^2\right]\right] \\ &= \underset{g}{\operatorname{argmin}} E\left[A_i\left[g|\Phi|^2 - |w^H h_\xi|^2 |\xi|^2\right]\right] \\ &= \underset{g}{\operatorname{argmin}}\, g - \frac{E\left[A_i\left[|w^H h_\xi|^2 |\xi|^2\right]\right]}{E[A_i[|\Phi|^2]]} \\ &= \frac{E\left[A_i\left[|w^H h_\xi|^2 |\xi|^2\right]\right]}{E[A_i[|\Phi|^2]]} \\ &= \frac{A_i[|\xi|^2] w^H R_\xi w}{A_i|\xi|^2 w^H R_\xi w + A_i[|\psi|^2] w^H R_\xi w},\end{aligned} \tag{12}$$

where the following definitions were used:

$$R_\xi = E[h_\xi h_\xi^H], \tag{13}$$

$$R_{\psi,i} = \frac{E\left[A_i\left[\int\int h(x)^H h(x') S(x) S(x') dx dx'\right]\right]}{E[A_i[\int\int S(x) S(x') dx dx']]} \tag{14}$$

and $$\begin{aligned}A_i[|\psi|^2] &= E[A_i[\iint S(x) S(x') dx dx']] \\ &= A_i[\iint E[S(x) S(x')] dx dx']\end{aligned} \tag{15}$$

Furthermore, a microphone covariance matrix may be defined as:

$$\begin{aligned}R_{M,i} &= A_i[|\xi|^2] R_\xi + A_i[|\psi|^2] R_\psi \\ &= E[A_i[\{Y_p Y_p^H\}_{p \in Z}]]\end{aligned} \tag{16}$$

In the following, the index i will be dropped from $R_\psi$ and $R_{\mathcal{M}}$. If it is assumed that the observations are of the form of equation (16), then equation (12) can be rewritten as $$g_i^* = \frac{A_i[|\xi|^2] w^H R_\xi w}{w^H R_{\mathcal{M}} w}. \tag{17}$$

It should be recalled that, in accordance with at least one embodiment of the present disclosure, one of the objectives is to compute the optimal real gain $g_i^*$, using equation (17). While the values of $A_i[|\xi|^2]$ and $A_i[|\psi|^2]$ are unknown, the matrices $R_\xi$, $R_\psi$, and $R_{\mathcal{M}}$ are sufficient to accomplish this task, as will be described in greater detail below. The matrices and $R_\psi$ are known from a model of the spatial scenario, and the observations provide an estimate of the matrix $R_{\mathcal{M}}$.

To obtain an estimate of $R_{\mathcal{M}}$, an ensemble estimate is not possible and thus it is advantageous for the following to be used:

$$R_{\mathcal{M}} \approx A_i[\{y_p y_p^H\}_{p \in Z}]. \tag{18}$$

This estimate for $R_{\mathcal{M}}$ may not be completely accurate. For example, the window should be such that $A_i[\xi \int_{R^3} h^H(x) s(x)\, dx] \approx 0$ and the effect of ensemble averaging on $R_\psi$ should be small. This is most easily satisfied by distributed interferers and by a window corresponding to an operator $A_i$ that involves substantial averaging.

D. General Solution

To find an expression for equation (17), described above, based on only the known parameters $R_\xi$, $R_\psi$, and $R_{\mathcal{M}}$, the power of the output of the beamformer may be considered, $$\omega^H R_{\mathcal{M}}\ \omega = A_i[|\psi|^2]\omega_H R_\psi \omega + A_i[|\xi|^2]\omega^H R_\xi \omega. \tag{19}$$

A normalization of equation (19) is $$\begin{aligned} w^H \overline{R}_{\mathcal{M}} w &= \frac{A_i[|\psi|^2]\|R_\psi\|_\psi}{\|R_{\mathcal{M}}\|_{\mathcal{M}}} w^H \overline{R}_\psi w + \frac{A_i[|\xi|^2]\|R_\xi\|_\xi}{\|R_{\mathcal{M}}\|_{\mathcal{M}}} w^H \overline{R}_\xi w \\ &= \frac{A_i[|\psi|^2]\|R_\psi\|_{\mathcal{M}}}{\|R_{\mathcal{M}}\|_{\mathcal{M}}} \frac{\|R_\psi\|_\psi}{\|R_\psi\|_{\mathcal{M}}} \|\overline{R}_\psi\|_w + \\ &\quad \frac{A_i[|\xi|^2]\|R_\xi\|_{\mathcal{M}}}{\|R_{\mathcal{M}}\|_{\mathcal{M}}} \frac{\|R_\xi\|_\xi}{\|R_\xi\|_{\mathcal{M}}} \|\overline{R}_\xi\|_w \\ &= (1-\lambda)\frac{\|R_\psi\|_\psi}{\|R_\psi\|_{\mathcal{M}}} \|\overline{R}_\psi\|_w + \lambda \frac{\|R_\xi\|_\xi}{\|R_\xi\|_{\mathcal{M}}} \|\overline{R}_\xi\|_w \end{aligned} \tag{20}$$

where the notation of equation (1) is used and additionally, for the case that w is a vector, $\|\overline{R}_\alpha\|_w = w^H \overline{R}_\alpha w$ is used, and where $\lambda \in [0, 1]$ is a suitably normalized $A_i[|\xi|^2]$, $$\lambda = \frac{A_i[|\xi|^2]\|R_\xi\|_{\mathcal{M}}}{\|R_{\mathcal{M}}\|_{\mathcal{M}}} \tag{21}$$

that represents the signal-power fraction of the beamformer output that is contributed by the desired source.

From equation (20), presented above, an expression may be obtained for the normalized desired-source gain $\lambda$ based on known entities only:

$$\begin{aligned} \lambda &= \frac{\|\overline{R}_{\mathcal{M}}\|_w - \frac{\|R_\psi\|_\psi}{\|R_\psi\|_{\mathcal{M}}}\|\overline{R}_\psi\|_w}{\frac{\|R_\xi\|_\xi}{\|R_\xi\|_{\mathcal{M}}}\|\overline{R}_\xi\|_w - \frac{\|R_\psi\|_\psi}{\|R_\psi\|_{\mathcal{M}}}\|\overline{R}_\psi\|_w} \\ &= \frac{\|\overline{R}_{\mathcal{M}}\|_w - \frac{\|\overline{R}_\psi\|_\psi}{\|\overline{R}_\psi\|_{\mathcal{M}}}\|\overline{R}_\psi\|_w}{\frac{\|\overline{R}_\xi\|_\xi}{\|\overline{R}_\xi\|_{\mathcal{M}}}\|\overline{R}_\xi\|_w - \frac{\|\overline{R}_\psi\|_\psi}{\|\overline{R}_\psi\|_{\mathcal{M}}}\|\overline{R}_\psi\|_w} \\ &= \frac{\|\overline{R}_{\mathcal{M}}\|_w - \frac{\|\overline{R}_\psi\|_w}{\|\overline{R}_\psi\|_{\mathcal{M}}}}{\frac{\|\overline{R}_\xi\|_w}{\|\overline{R}_\xi\|_{\mathcal{M}}} - \frac{\|\overline{R}_\psi\|_w}{\|\overline{R}_\psi\|_{\mathcal{M}}}}. \end{aligned} \tag{22}$$

It is important to note that equation (22) is a generic relationship that is valid if the observed covariance matrix $R_{\mathcal{M}}$ is a combination of the interference covariance matrix $R_\psi$ and the desired-source covariance matrix $R_\xi$. In a real-world environment this is generally an approximation.

The optimal gain function may be computed under the assumption that the observed covariance matrix is a combination of the desired-source covariance matrix and the interference covariance matrix. Equations (21) and (17) give the following:

$$\begin{aligned} g^* &= \frac{A_i[|\xi|^2]w^H R_\xi w}{w^H R_{\mathcal{M}} w} \\ &= \lambda \frac{\|R_{\mathcal{M}}\|_{\mathcal{M}}}{\|R_\xi\|_{\mathcal{M}}} \frac{\|R_\xi\|_w}{\|R_{\mathcal{M}}\|_w} \\ &= \lambda \frac{\|\overline{R}_{\mathcal{M}}\|_{\mathcal{M}}}{\|\overline{R}_{\mathcal{M}}\|_w} \frac{\|\overline{R}_\xi\|_w}{\|\overline{R}_\xi\|_{\mathcal{M}}} \\ &= \lambda \frac{1}{\|\overline{R}_{\mathcal{M}}\|_w} \frac{\|\overline{R}_\xi\|_w}{\|\overline{R}_\xi\|_{\mathcal{M}}} \\ &= \frac{1 - \frac{\|\overline{R}_\psi\|_w}{\|\overline{R}_\xi\|_{\mathcal{M}}} \frac{1}{\|\overline{R}_{\mathcal{M}}\|_w}}{1 - \frac{\|\overline{R}_\psi\|_w}{\|\overline{R}_\psi\|_{\mathcal{M}}} \frac{\|\overline{R}_\xi\|_{\mathcal{M}}}{\|\overline{R}_\xi\|_w}}. \end{aligned} \tag{23}$$

By analyzing the behavior of equation (23), it should be noted that the factor $$\frac{\|\overline{R}_\psi\|_w}{\|\overline{R}_\psi\|_M}$$

is shared by the numerator and denominator. It is small in the direction of the beam and relatively large (but generally less than 1) in other directions. For a local signal $y_i$ arriving from a location near the desired source, $\|\overline{R}_{\mathcal{M}}\|_w \approx 1$ and $\|\overline{R}_\xi\|_{\mathcal{M}} \approx 1$. Moreover, in natural setups $\|\overline{R}_\xi\|_w \approx 1$, independently of the current signal. Thus, for a signal from the desired source location, $g^* \approx 1$. In contrast, for a signal coming from a location far from the location of the desired source, $\|\overline{R}_{\mathcal{M}}\|_w << 1$, which reduces the numerator and results in a reduction of $g^*$. This result is strengthened by the denominator: $\|\overline{R}_{\mathcal{M}}\|_w << 1$ results in an increase of the denominator.

Next, the effect of mismatch of interferer and desired source is considered. If the true desired source is mismatched to the model desired source, then the $\|\overline{R}_{\mathcal{M}}\|_w$ and $\|\overline{R}_\xi\|_{\mathcal{M}}$ are reduced from their expected values, which means that $g^*$ decreases. This is as expected.

If the interferer is mismatched then $\|\overline{R}_\psi\|_{\mathcal{M}}$ will be smaller than optimal when the signal matches the true interferer, thus strengthening the subtractive terms in the numerator and denominator, further reducing $g^*$. As such, it may be expected that a mismatch in general results in stronger suppression. This may appear to contradict the logic that led to equation (6), described above. It is a result of the fact that equation (22) is valid only under the constraint that the observed covariance should be a linear combination of the desired-source and interferer covariance matrices.

It is important to appropriately handle the situation where the subtractive terms are too large because of scenario mismatch. Because of the mismatch behavior described above, the situation can be appropriately handled by using simple range limiters:

$$g^* = \frac{1 - \min\left(\alpha, \frac{\|\overline{R}_\psi\|_w}{\|\overline{R}_\psi\|_{\mathcal{M}}} \frac{1}{\|\overline{R}_{\mathcal{M}}\|_w}\right)}{1 - \min\left(\alpha, \frac{\|\overline{R}_\psi\|_w}{\|\overline{R}_\psi\|_{\mathcal{M}}} \frac{\|\overline{R}_\xi\|_{\mathcal{M}}}{\|\overline{R}_\xi\|_w}\right)}, \tag{24}$$

where $\alpha$ is a suitably selected constant (e.g., advantageously selected as $\alpha=0.999$). It is noted that for scenarios where the interferer dominates, the min operator limits generally only in the numerator, whereas in scenarios where the desired source dominates, both the numerator and denominator are limited by the min operators.

Up to the present point, the choice of the beamformer $\omega$ has been left open. The matched-filter beamformer where $w=h(x_\xi)$ is a reasonable choice.

At very low frequencies (e.g., below 200 Hz) performance may be inadequate and it is natural to simply use the average $g^*$ of a range of frequencies above the baseband.

E. Example Scenarios

The above description provides an example method for finding the optimal gain $g^*$ which, in accordance with one or more embodiments of the present disclosure, may include the following: determine $R_\xi$ and $R_\psi$ from the scenario, measure $R_M$, set $\omega$, and use equation (24) to compute the gain. The following description addresses several natural specifications for the matrices $R_\xi$ and $R_\psi$.

The scenarios described in the following are distinguished by the form of the response vector h to a source at a point $x \in R^3$ and by the form of S(x), and $f$. For particular scenarios, the matrices $R_\xi$ and $R_\psi$ can be solved analytically.

It should first be noted that for sound propagation, the response of a single microphone at the origin to a unit sound at x is a Hankel function $$h(x) = \frac{e^{-jk|x|}}{4\pi|x|} \tag{25}$$

where k is the wavenumber (the wavenumber is $$k = \frac{2\pi f}{c}$$

where $f$ is frequency in Hz, and c is the speed of sound; it is a normalized frequency that can be interpreted as the number of radians per unit length (or the number of waves per unit length multiplied by $2\pi$)). Specific scenarios may be derived from this basic form of h(x) and the linearity of the wave equations.

There are two natural classifications for the beamforming scenarios: (i) near-field versus far-field, and (ii) linear arrays versus "other" arrays. It should be noted that near-field is, in fact, the general case, whereas far-field is a special case. The far-field linear array case is particularly convenient to solve.

As it is straightforward to solve, and a good description of many practical scenarios, the far-field linear array case may be considered. In the far-field case, it is assumed that the sources are sufficiently far away that equation (25) can be approximated by a plane wave. As such, only the angle at which the plane wave approaches the array is of any consequence. Let $\theta$ be the angle away from broadside arrival on the array of the source. Without loss of generality, the gain of the transfer function can be absorbed into the power of the source. The vector source response of the array to a point source is then, with some abuse of notation in the argument of h, $$h(\theta) = \frac{1}{\sqrt{M}}[1, e^{-jkd\sin(\theta)}, \ldots, e^{-jMkd\sin(\theta)}]^T. \tag{26}$$

The following describes specific example scenarios for the desired-source spatial covariance matrix and the interferer spatial covariance matrix.

1. The Desired-Source Spatial Covariance Matrix, $R_\xi$:

The following description considers the case where the desired-source location is known and the case where the desired-source is far-field with a uniform location distribution over an angular segment, for a linear array.

(a) Known Desired Source Location:

Particularly at low frequencies, it is natural and often accurate to assume the location of the desired source is known $f(x)=\delta(x)$. In the present example scenario, $R_\xi=h(x_\xi)h(x_\xi)^H$.

For the far-field linear array case, $h(x_\xi)$ takes the form $$h(\theta_\xi) = \frac{1}{\sqrt{M}}[1, e^{-jkd\sin(\theta_\xi)}, \ldots, e^{-jMkd\sin(\theta_\xi)}]^T, \tag{21}$$

The assumptions for the estimation of $R_M$ are reasonable in this case.

(b) Far-Field, Box-Car Angular Desired-Source Distribution:

Particularly for high frequencies, where the response has a sharp main lobe, it is advantageous to consider uncertainty in the location of the desired source. The present example considers the probability of the angular location of the desired source to be uniform in the interval $\theta \in [-c,c]$. The spatial covariance matrix is, for $l \neq m$, $$\begin{aligned}[R_\xi]_{lm} &= \frac{1}{M}\int_{-c}^{c} e^{-jlkd\sin(\theta_\xi)} e^{jmkd\sin(\theta_\xi)} d\theta_\xi \\ &= \frac{1}{M}\int_{-c}^{c} e^{j(m-l)kd\sin(\theta_\xi)} d\theta_\xi \\ &\approx \frac{1}{M}\int_{-c}^{c} e^{j(m-l)kd\theta_\xi} d\theta_\xi \\ &= \frac{2}{M}\frac{\sin((m-l)kdc)}{M(m-l)kd}, \; m \neq l\end{aligned} \tag{28}$$

where the approximation $\sin(\theta_\xi) \approx \theta_\xi$ is made for small $\theta_\xi$. For m=l, the following is given (without the need for approximation):

$$[R_\xi]_{mm} = \frac{1}{M}\int_{-c}^{c} d\theta_\psi = \frac{2c}{M}. \tag{29}$$

2. The Interfering-Source Spatial Covariance Matrix, $R_{\xi,i}$:

A number of example scenarios are described below, including the case where the interferer is a point source of known location, and the case where the interference comes from a uniformly distributed set of far-field interferers, which may have a gap, and is received by a linear array.

(a) Known Interferer Location:

The following considers the case where there is one interfering source located at a particular location $x_\psi$. If true, this is generally accurate only for low frequencies. The interfering source is then associated with a covariance matrix $R_\psi = h(x_\psi)h(x_\psi)^H$.

For the far-field linear-array case, $h(x_\psi)$ takes the form $$h(\theta_\psi) = \frac{1}{\sqrt{M}}\left[1, e^{-jkd\sin(\theta_\psi)}, \ldots, e^{-jMkd\sin(\theta_\psi)}\right]^T. \tag{30}$$

(b) Far-Field, Linear Array, Uniform Interference:

Under the assumption that there are uniform sources across all angles and no correlation between different angles:

$$E[A_i[S(\theta_\psi)S(\theta_\psi')]]=\sigma_S^2\delta(\theta_\psi-\theta_\psi'). \tag{31}$$

where $S(\theta)$ is the signal at an angle $\theta$, and $\sigma_S^2$ is an angular density of the variance of the source, which may be assumed to be time-invariant.

It is important to note that the expectation, E, in equation (31) is generally needed to make the right-hand side of the equation vanish for $\theta_\psi \neq \theta_\psi'$. However, this is not consistent with the estimation of $R_{\mathcal{M}}$ in a practical system, which is subjected only by the operator $A_i$. Therefore, in accordance with at least one embodiment of the present disclosure, in implementations of the methods and systems described herein the following stronger assumption may be made:

$$A_i[S(\theta_\psi)S(\theta_\psi')]\approx\sigma_S^2\delta(\theta_\psi-\theta_\psi'), \tag{32}$$

It should be understood by those skilled in the art that, in some practical conditions, equation (32) may not be satisfied.

If equation (31) holds, the interference covariance matrix is time-invariant and thus can be written as $$\begin{aligned}[R_{\psi,i}]_{lm} &= \frac{\sigma_S^2}{M}\int_0^{2\pi} e^{-jlkd\sin(\theta_\psi)}e^{jmkd\sin(\theta_\psi)}d\theta_\psi \\ &= \frac{\sigma_S^2}{M}\int_0^{2\pi} e^{j(m-l)kd\sin(\theta_\psi)}d\theta_\psi \\ &= \frac{\sigma_S^2}{M}J_0((m-l)kd),\end{aligned} \tag{33}$$

which uses that the integral is a zero-order Bessel function of the first kind, denoted by $J_0$.

(c) Far-Field, Linear Array, Gapped Uniform Interference:

The example scenario described above (Far-Field, Linear Array, Uniform Interference) may be extended to allow a gap in the background interference. To simplify the derivation, it may be assumed that the gap is centered at $\theta_\xi=0$, which is usually where the desired source is located. However, as described in greater detail below, the derivation may be readily extended to the desired source being located anywhere.

Consider the case where the density of the interfering sources is $$\nu^2(\theta_\psi) = \begin{cases} 0, & \theta_\psi \in [0, b) \cup (\pi - b, 2\pi] \\ \sigma_S^2, & \theta_\psi \in [b, 2\pi - b] \end{cases} \tag{34}$$

where it is noted that $\nu^2$: R→R is a periodic function with period $2\pi$.

Generalizing equation (33) to facilitate the gap gives $$\begin{aligned}[R_{\psi,i}]_{lm} &= \frac{1}{M}\int_0^{2\pi} \nu^2(\theta_\psi)e^{-jlkd\sin(\theta_\psi)}e^{jmkd\sin(\theta_\psi)}d\theta_\psi \\ &= \frac{\sigma_S^2}{M}J_0((m-l)kd) - \frac{\sigma_S^2}{M}\int_{-b}^{b} e^{j(m-l)kd\sin(\theta_\psi)}d\theta_\psi\end{aligned} \tag{35}$$

For sufficiently small b, the approximation $\sin(\theta_\psi)=\theta_\psi$ can be made. This results in, for $l\neq m$:

$$\begin{aligned}[R_{\psi,i}]_{lm} &\approx \frac{\sigma_S^2}{M}J_0((m-l)kd) - \frac{\sigma_S^2}{M}\int_{-b}^{b} e^{j(m-l)kd\theta_\psi}d\theta_\psi \\ &= \frac{\sigma_S^2}{M}J_0((m-l)kd) - \frac{2\sigma_S^2\sin((m-l)kdb)}{M(m-l)kd} \\ & l \neq m\end{aligned} \tag{36}$$

and for l=m, this gives (without the need for approximation):

$$\begin{aligned}[R_{\psi,i}]_{mm} &= \frac{\sigma_S^2}{M}J_0((m-m)kd) - \frac{\sigma_S^2}{M}\int_{-b}^{b} d\theta_\psi \\ &= \frac{\sigma_S^2}{M} - 2\sigma_S^2 b \\ &= \frac{\sigma_S^2}{M}(1-2b).\end{aligned} \tag{37}$$

It should be noted that the same or similar procedure as described above may be used for gaps in $\nu^2$ for other intervals on $[0, 2\pi]$. However, in the present example, second-order approximations should be used, and the resulting covariance matrix is Hermitian, but, in general, not real.

The covariance matrix specified by equations (37) and (36), described above, may not be guaranteed to be positive semi-definite because of the approximation $\sin(\theta_\psi)=\theta_\psi$. In a practical application, the matrix may be forced to be positive semi-definite by, for example, reducing the rank of the matrix by zeroing negative eigenvalues in a spectral decomposition.

(d) Combinations of the Interferer:

The interferes described above (e.g., the point interferer and the uniform interferer) may be combined:

$$R_\psi = \beta\frac{\sigma_S^2}{M}J_0((m-l)kd) + (1-\beta)h(x_\psi)h(x_\psi)^H,\ \alpha \in [0, 1], \tag{38}$$

where $\beta$ is set to a value suitable for the scenario.

F. Wide-Band Considerations

The example solution methods described above, in accordance with one or more embodiments of the present disclosure, assume that the physical system involved satisfies equation (7). However, it may be the case that equation (7) holds only for narrow-band systems. For example, in accordance with at least one embodiment, signals may first be converted to a time-frequency representation and then the theory described above may be applied to each frequency channel separately. In this manner, the problem is solved for each frequency band separately without exploiting knowledge of events in nearby frequencies bands. In some scenarios, the behavior of the solution procedure may depend significantly on the frequency of the channel. The basic behavior of the beamformer (equation (8), described above)

can be affected by frequency. In addition, equation (24) may also be dependent on frequency.

The frequency dependency of equation (24) can be countered by the usage of equations (5) and (6). Thus, by using multiple desired-source scenarios the beamwidth can be widened.

The dynamic range of $\|\overline{R}_M\|_w$ is large at high frequencies. However, at high frequencies, the angular response is sensitive to misestimates of the $R_M$ and incorrect assumptions for $f$. This may lead to erratic behavior that may be perceived as musical noise. These effects can be reduced by, for example, making the operator $A_i$ average over longer time periods and/or frequency bands and by considering various scenarios using equation (5) or equation (6). In addition, the effects can be improved by introducing memory in the estimation of the gain.

In contrast to high frequencies, the dynamic range of $\|\overline{R}_M\|_w$ for low frequencies is relatively small, and this makes the estimate of $\lambda$ sensitive to misestimation of $R_M$ at low frequencies. This can lead, for example, to scenarios where overestimates of the value for $\lambda$ dominate. Such estimation issues can be reduced, for example, by making the operator $A_i$ average over longer periods of time and by considering various scenarios using equations (5) or (6).

At low frequencies, averaging in frequency may not be effective for improving the estimate, as speech generally has a harmonic structure at low frequencies. Therefore, in accordance with one or more embodiments described herein, any of the following three structures may be used under such circumstances:

(i) The spatial covariance at a particular frequency may be averaged with the spatial covariance (or the gain directly) at a set of integer multiples of that frequency;

(ii) The gain associated with an integer multiple of that frequency may be used, thus ignoring low-frequency estimation altogether; or (iii) The gain may be replaced with the average gain for a higher frequency band.

EXAMPLE

To further illustrate the various features of the robust beamforming methods and systems of the present disclosure, the following describes some example results that may be obtained through experimentation. It should be understood that although the following provides example performance results in the context of a far-field implementation of the system with known desired and interferer locations for artificial data, using a delay-sum preprocessor, the scope of the present disclosure is not limited to this particular context or implementation. While the following description illustrates that excellent performance can be achieved with only a small number (e.g., two) of microphones, and also that the performance is robust, similar levels of performance may also be achieved using the methods and systems of the present disclosure in various other contexts and/or scenarios.

The following provides example results for two hypothetical cases. The first is an example where the desired-source and interferer scenarios are known. In the second case, the effectiveness of equation (6) is demonstrated by sweeping a white-noise point source over 360 degrees around a two-microphone beamformer.

A. Overview of Setup

In the following examples, a two-microphone beamformer is implemented in the time-frequency-domain using a two-times oversampled Gabor window with a Kaiser-Bessel-derived (KBD) window ($\alpha$=1.5) and a window length of 64 ms. The beamformer is a delay-sum preprocessor. It should be noted that the delay-sum beamformer may be omitted (and thus the selection of a single microphone signal is used as preprocessor) with only a minor impact on performance.

For the first case, example data is created by combining two utterances of about eight seconds in length spoken by different persons, and sampled at 16 kHz. As described above, two microphones are employed. The data involves a scenario where the desired talker is positioned straight ahead of (e.g., straight in front of) the microphones, and one interfering talker is positioned at 45 degrees ($\pi/4$ radians) in relation to the position of the desired talker with respect to the microphones.

It should be noted that the methods and systems of the present disclosure are designed to achieve similar performance with numerous other configurations (e.g., positioning) of the desired talker and the interfering talker with respect to the microphones, in addition to the example configuration described above. The model is informed about the location of the desired and interfering talkers.

In the second case, example data is obtained by sweeping a white-noise point source in 3.2 seconds over 360 degrees around the two-microphone beamformer. One interferer scenario is a combination of the uniform noise scenario and the point source scenario at 45 degrees. The second interferer scenario is a combination of the uniform noise scenario and the point source scenario at −45 degrees. Nine desired-source scenarios are set up to construct a beam. The masking function is shown with a single postfilter and with the concatenated postfilters.

Figure 3:
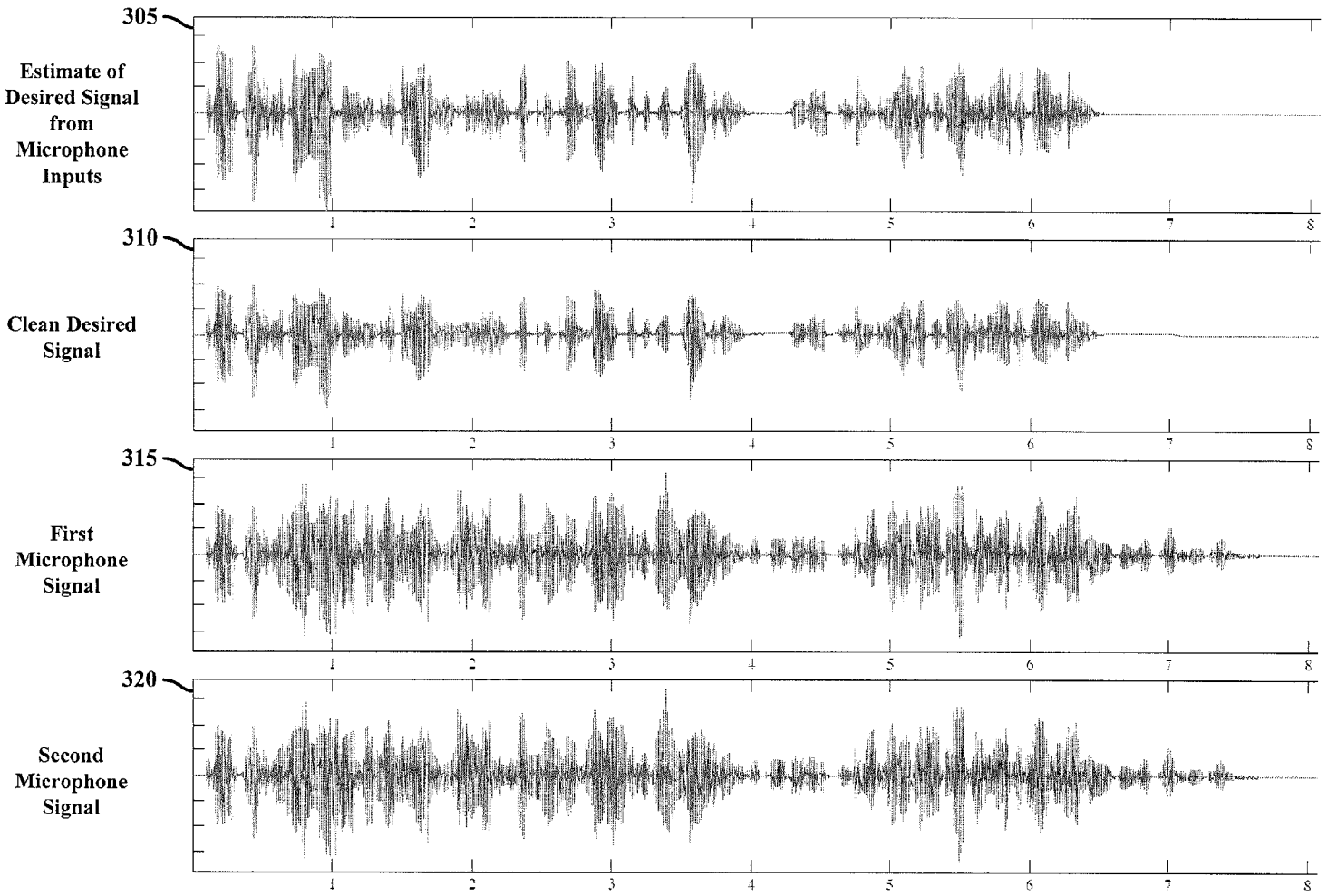
FIG. 3 is a set of graphical representations illustrating example performance results for a two-microphone beamformer in the time-domain according to one or more embodiments described herein.

FIG. 3 illustrates performance results for the two-microphone beamformer of the present example. The bottom two plots, 315 and 320 show the input signals to the first and second microphones, respectively. The second plot 310 from the top shows the clean desired signal. It can be seen that the microphone signals are contaminated with the speech of the second talker, who is speaking at similar loudness as the desired talker. The top plot 305 shows the extracted signal (e.g., estimate of the desired signal extracted from the first and second microphone inputs shown in plots 315 and 320, respectively). Visual inspection of the extracted signal 305 indicates that the interfering talker is largely removed from the signal.

Figure 4:
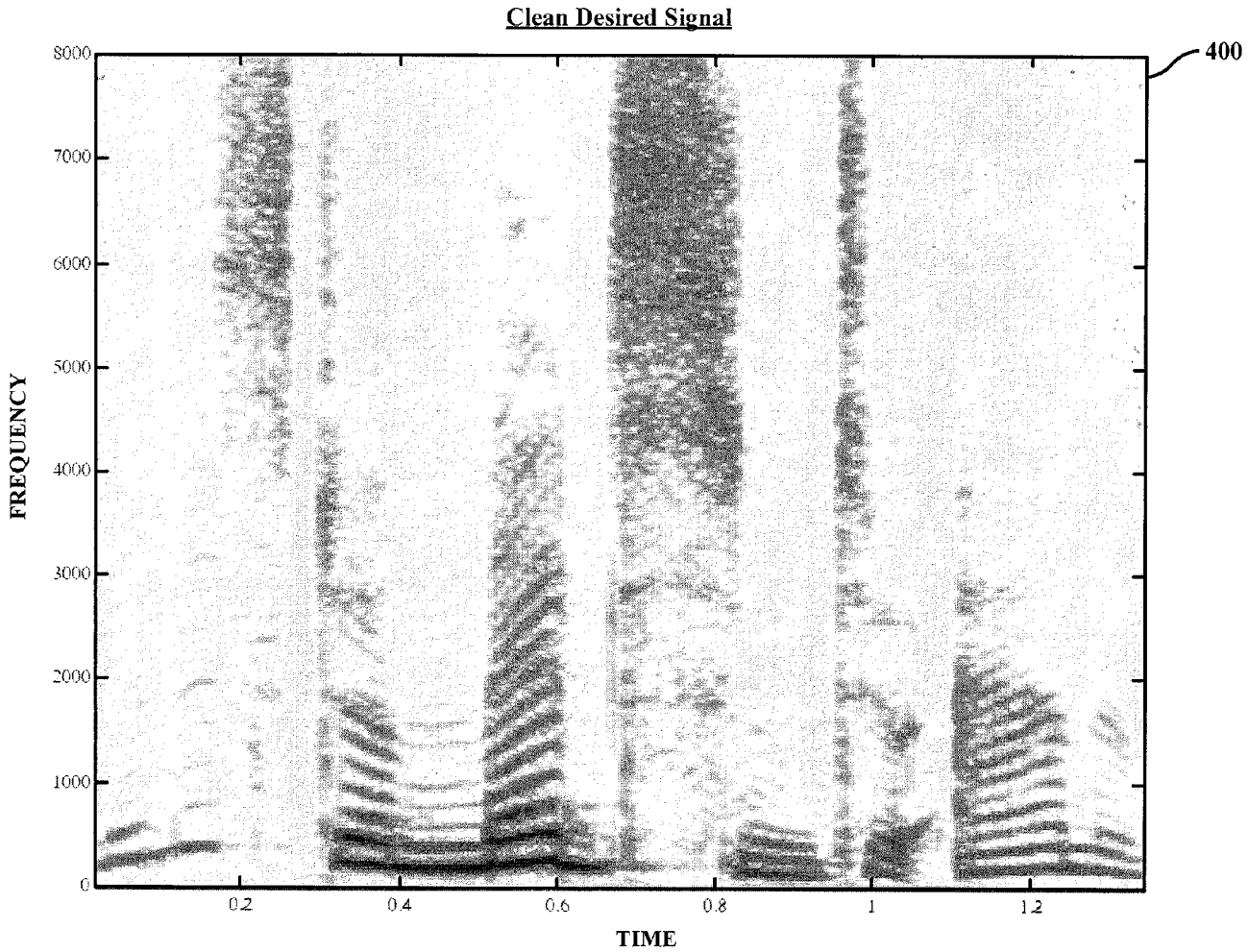
FIG. 4 is an example time-frequency representation of a desired audio signal according to one or more embodiments described herein.
Figure 5:
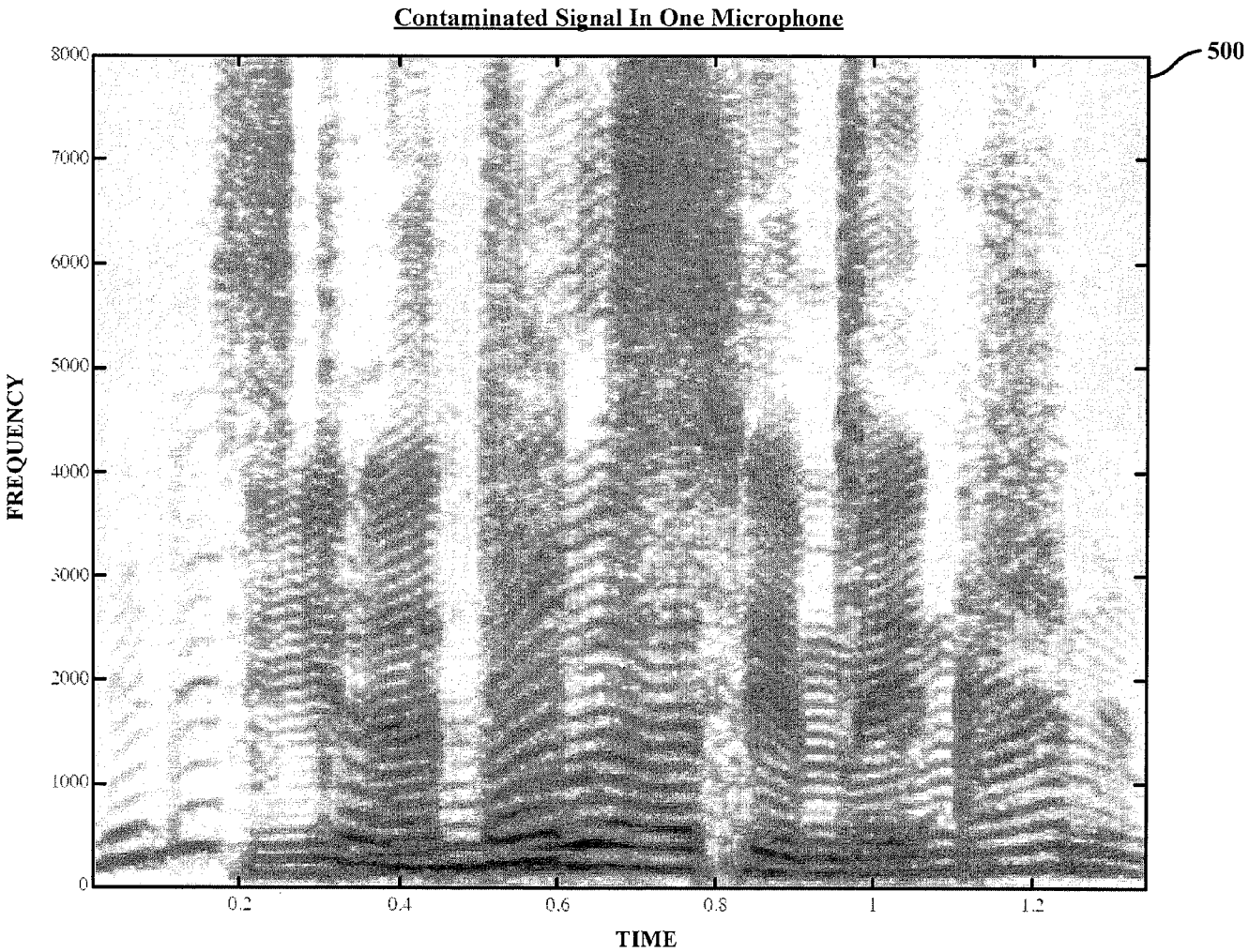
FIG. 5 is an example time-frequency representation of combined audio input signals as observed by a single microphone in an environment with two talkers.
Figure 6:
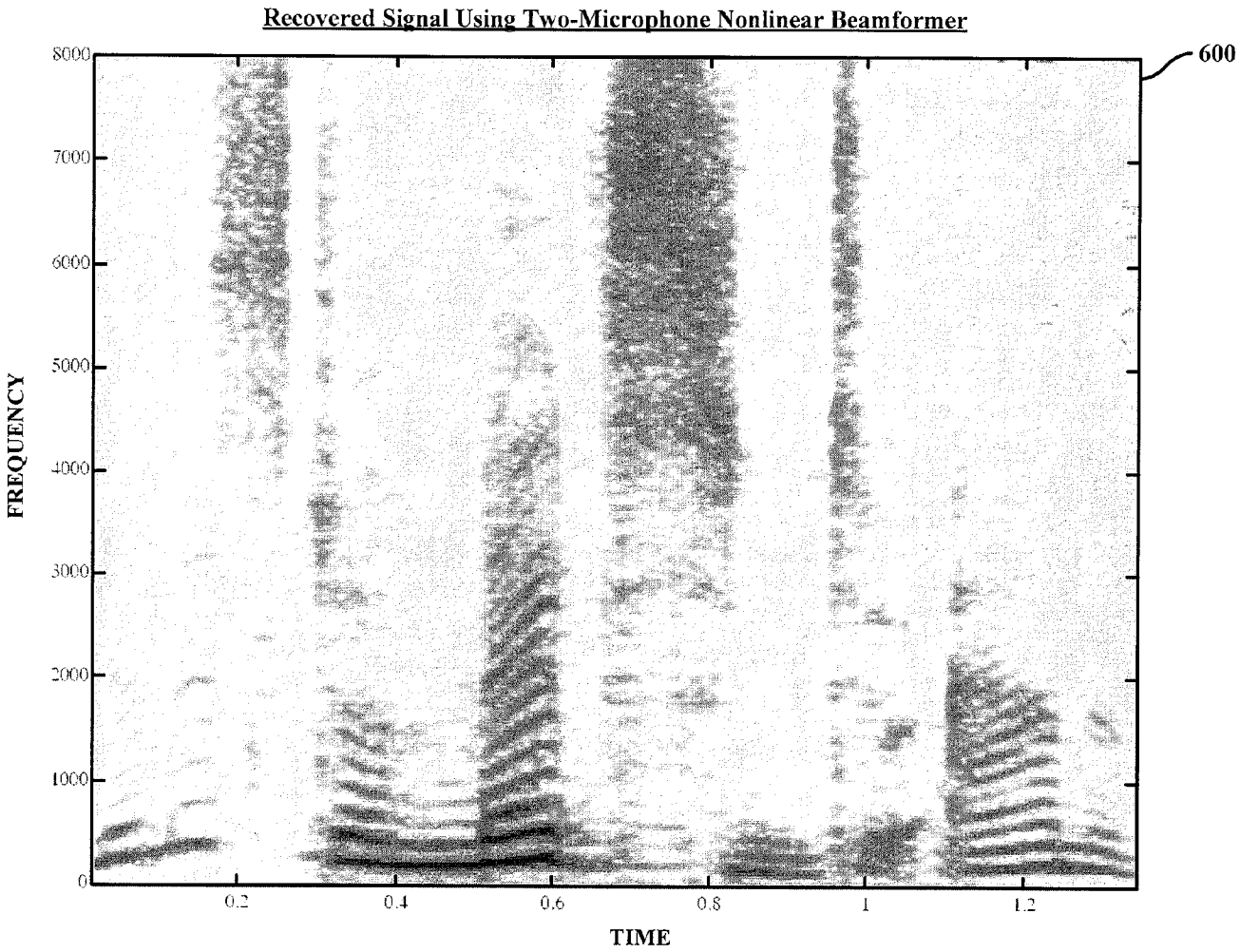
FIG. 6 is an example time-frequency representation of an audio signal recovered using a beamformer according to one or more embodiments described herein.

The conclusion that the interfering talker is largely removed from the signal by the two-microphone beamformer is confirmed by the time-frequency representations (e.g., spectrograms) illustrated in FIGS. 4-6, which show corresponding sub-segments of the signals illustrated in FIG. 3 and described above.

FIG. 4 is a time-frequency representation plot 400 of the clean desired signal, FIG. 5 is a time-frequency representation plot 500 of the mix of the two signals (e.g., the combined signals from the first and second microphones) as observed in one of the microphones (it should be noted that a similar observation is made in the other of the two microphones), and FIG. 6 is a time-frequency representation plot 600 showing the output of the beamformer (e.g., the recovered signal) described above with respect to the present example. Plots 400, 500, and 600 illustrate that the desired signal is recovered with only slight contamination at the onsets.

Even with only a small number (e.g., two) of microphones, the nonlinear beamforming postprocessor (and corresponding nonlinear beamforming post-processing method) of the present disclosure is able to remove interfering signals where, for example, the spatial covariance matrices of the desired source and the interfering sources are known. It is understandable that this result can be obtained for situations where, in each time-frequency bin, either the desired source or the interfering source dominates. Such situations occur frequently in the real world.

Figure 7:
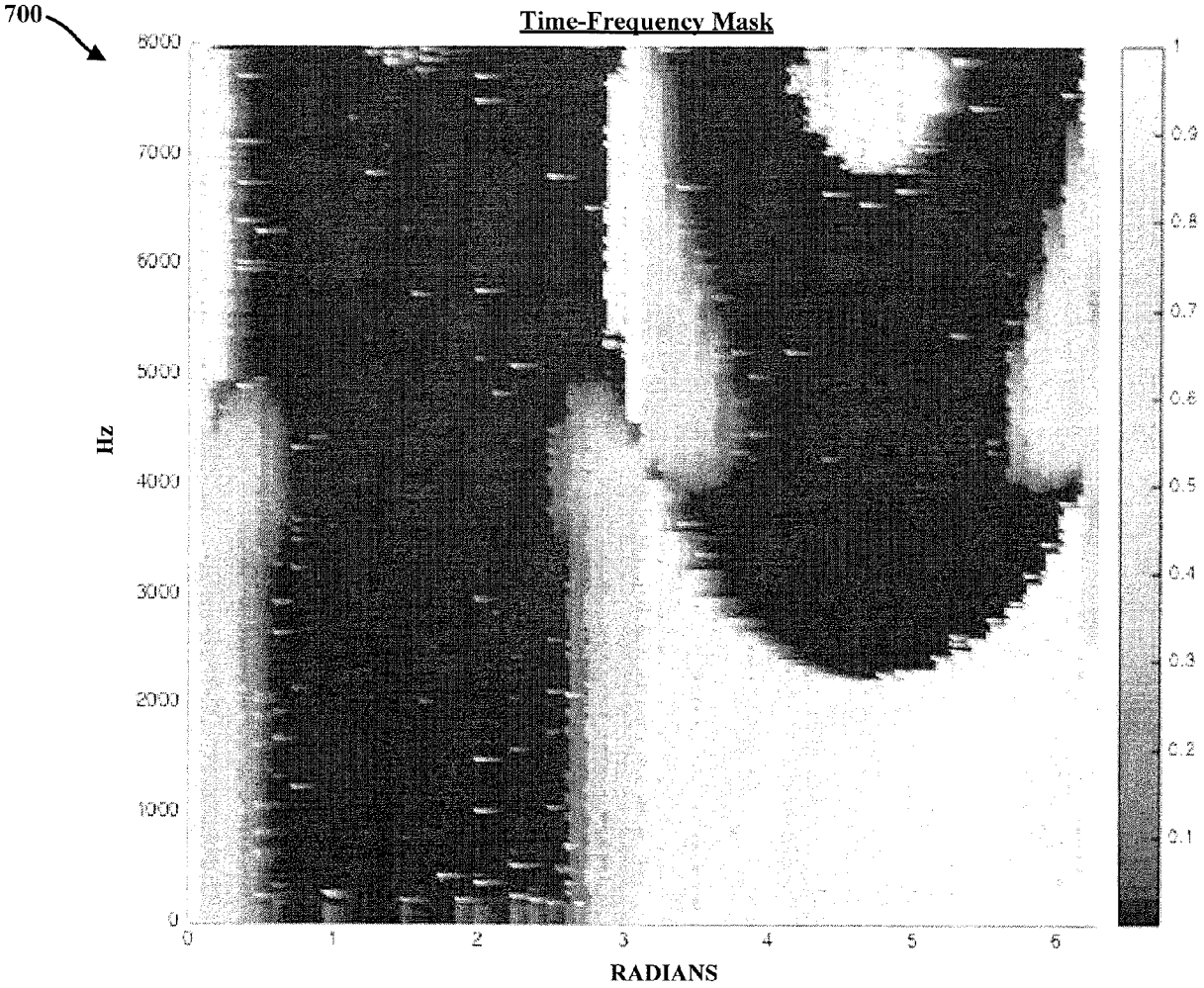
FIG. 7 is a graphical representation illustrating an example response of a single postfilter to a point source sweeping across 360 degrees.
Figure 8:
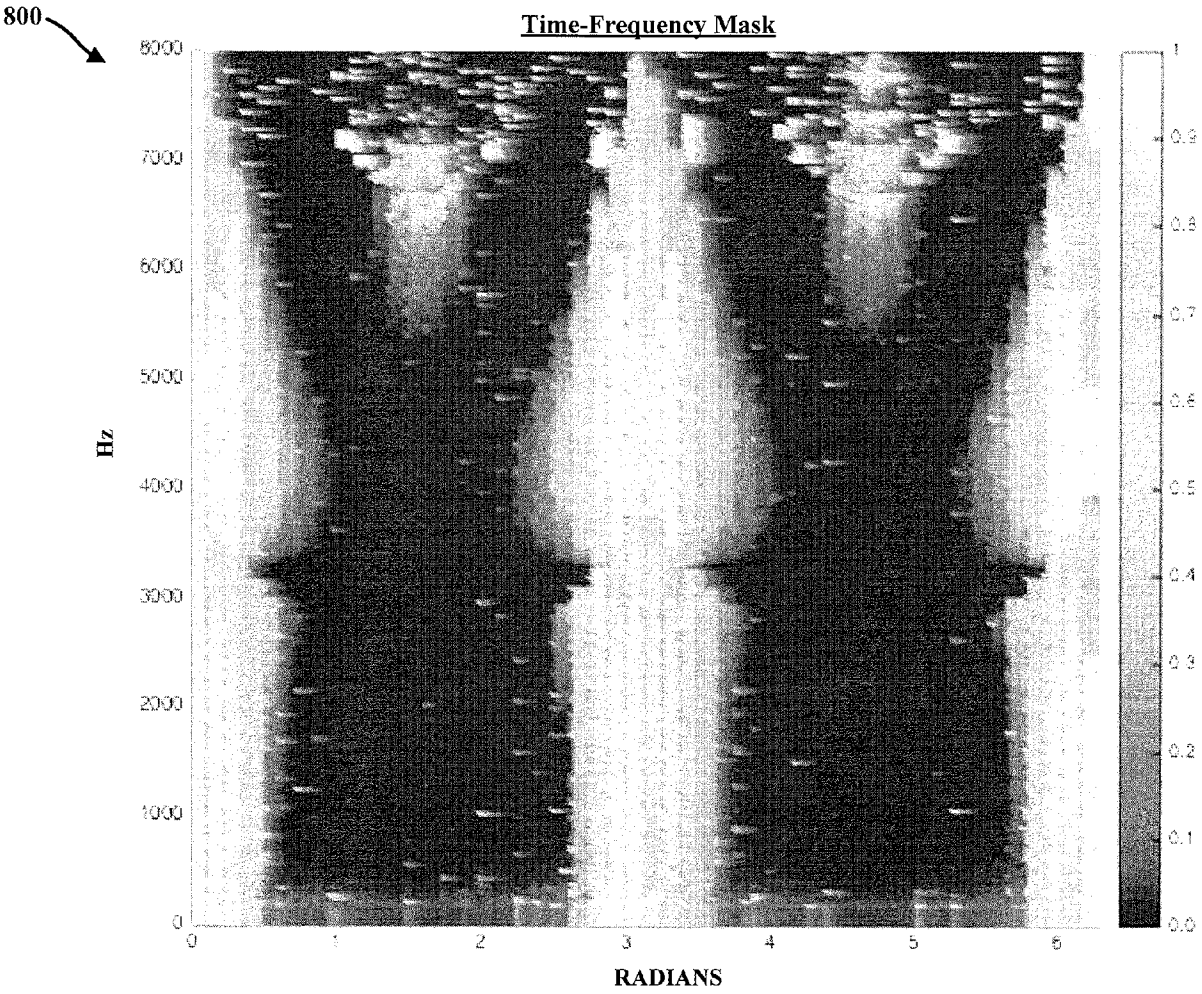
FIG. 8 is a graphical representation illustrating an example response of multiple postfilters to a point source sweeping across 360 degrees, where the postfilters are selected to render a beamwidth of 0.6 radians and suppress elsewhere.

FIGS. 7 and 8 illustrate the effect of the concatenation of multiple filters, in accordance with one or more embodiments described herein. The signal is a point source rotating over a full 360 degrees ($2\pi$ radians) in 3.2 seconds. FIG. 7 is a graphical representation 700 showing an example response for the case of a single scenario with modeled desired source at 0 degrees and a modeled interferer that is an equal mix of a uniform interferer and a point interferer at 1.5 radians on the right. It may be observed that the beam is narrow and rejection is particularly poor between 3.5 and 5.5 radians.

FIG. 8 is a graphical representation 800 showing an example response for the case where two model interferer scenarios (one scenario as before (e.g., described above with respect to FIG. 7), and the other its reflection around zero degrees) and nine model desired-source scenarios, with beams pointing from −0.3 to 0.3 radians, are considered. The postfilters are cascaded as described above with respect to equation (6). However, it should be noted that equation (5) provides nearly indistinguishable results. The gain below 200 Hz is obtained by averaging the gain from 200 to 400 Hz. Comparison of the single-scenario case in FIG. 7 and the multi-scenario case in FIG. 8 illustrates that the multi-scenario setup can simultaneously widen the beam and increase suppression. In addition, FIG. 8 shows that the multi-scenario system is able to remove interferers in a broad range of angles. In other words, the system performs well even for unknown interferer scenarios.

It should be noted that results illustrated in FIGS. 7 and 8 indicate that the strategy of equation (6) or equation (5) is not necessarily guaranteed to always improve performance, and therefore, in practice, it is useful to consider different scenario configurations to obtain optimal performance.

As is evident from the above descriptions, the methods and systems of the present disclosure provide an optimal post-processor that consists of a selection of one postfilter from a set of postfilters, or a cascade of postfilters, where each postfilter is optimal for a particular scenario. Each postfilter individually is based on optimizing the gain for each time-frequency bin based on knowledge of the spatial covariance matrices of the desired source and of the interfering sources. The example performance results described above confirm that for common scenarios the methods and systems of the present disclosure outperforms existing beamforming techniques.

For example, the hypothetical results described above illustrate that with only two microphones the beamforming method and system of the present disclosure can remove an unknown interfering source signal over a range of unknown locations. While some existing approaches attempt to achieve similar results, such existing approaches do not perform well in practice: their performance is obtained by providing extremely high gain for signals that were implicitly assumed not to exist, but are present in practice. In contrast, the methods and systems of the present disclosure are robust in their performance: their performance degrades gracefully with decreasing accuracy of the specified locations of desired and interfering sources.

Figure 9:
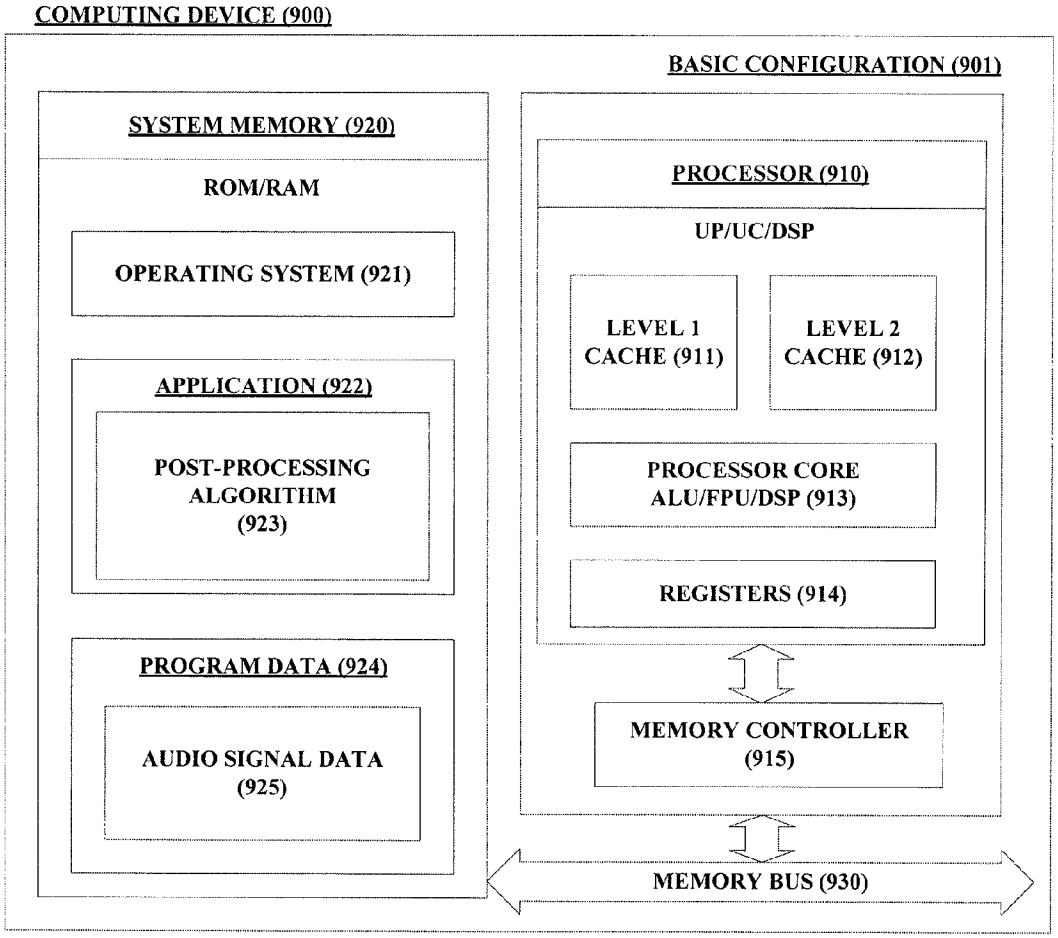
FIG. 9 is a block diagram illustrating an example computing device arranged for spatially selecting acoustic sources using an adaptive post processor according to one or more embodiments described herein.

FIG. 9 is a high-level block diagram of an exemplary computer (900) arranged for estimating, from a set of audio signals (e.g., microphone signal), a desired source signal using a beamformer with a set of postfilters, where each of the postfilters multiplies each time-frequency bin with an optimal gain, according to one or more embodiments described herein. In a very basic configuration (901), the computing device (900) typically includes one or more processors (910) and system memory (920). A memory bus (930) can be used for communicating between the processor (910) and the system memory (920).

Depending on the desired configuration, the processor (910) can be of any type including but not limited to a microprocessor (μP), a microcontroller (μC), a digital signal processor (DSP), or any combination thereof. The processor (910) can include one more levels of caching, such as a level one cache (911) and a level two cache (912), a processor core (913), and registers (914). The processor core (913) can include an arithmetic logic unit (ALU), a floating point unit (FPU), a digital signal processing core (DSP Core), or any combination thereof. A memory controller (916) can also be used with the processor (910), or in some implementations the memory controller (915) can be an internal part of the processor (910).

Depending on the desired configuration, the system memory (920) can be of any type including but not limited to volatile memory (such as RAM), non-volatile memory (such as ROM, flash memory, etc.) or any combination thereof. System memory (920) typically includes an operating system (921), one or more applications (922), and program data (924). The application (922) may include post-processing algorithm (923) for removing interfering source signals at known locations, in accordance with one or more embodiments described herein. Program Data (924) may include storing instructions that, when executed by the one or more processing devices, implement a method for spatially selecting acoustic sources by using a beamformer that optimizes the gain applied to each time-frequency bin based on knowledge of the spatial covariance matrix of the desired source, the spatial covariance matrix of the interfering sources, and microphone signals in some neighborhood of the time-frequency bin, according to one or more embodiments described herein.

Additionally, in accordance with at least one embodiment, program data (924) may include audio signal data (925), which may include data about the locations of a desired source and interfering sources. In some embodiments, the application (922) can be arranged to operate with program data (924) on an operating system (921).

The computing device (900) can have additional features or functionality, and additional interfaces to facilitate communications between the basic configuration (901) and any required devices and interfaces.

System memory (920) is an example of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 900. Any such computer storage media can be part of the device (900).

The computing device (900) can be implemented as a portion of a small-form factor portable (or mobile) electronic device such as a cell phone, a smart phone, a personal data assistant (PDA), a personal media player device, a tablet computer (tablet), a wireless web-watch device, a personal headset device, an application-specific device, or a hybrid device that include any of the above functions. The computing device (900) can also be implemented as a personal computer including both laptop computer and non-laptop computer configurations.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In accordance with at least one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers, as one or more programs running on one or more processors, as firmware, or as virtually any combination thereof, and that designing the circuitry and/or writing the code for the software and or firmware would be well within the skill of one of skill in the art in light of the present disclosure.

In addition, those skilled in the art will appreciate that the mechanisms of the subject matter described herein are capable of being distributed as a program product in a variety of forms, and that an illustrative embodiment of the subject matter described herein applies regardless of the particular type of non-transitory signal bearing medium used to actually carry out the distribution. Examples of a non-transitory signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A system comprising:

at least one processor; and a computer-readable medium coupled to the at least one processor having instructions stored thereon which, when executed by the at least one processor, causes the at least one processor to for one or more coefficients characterizing an output signal:

select a desired-source scenario from a set of predefined desired-source scenarios to maximize the amplitude of the output signal;

select an interference scenario from a set of predefined interference scenarios to minimize the amplitude of the output signal; and apply a gain to the output signal based on the selected desired-source scenario and the selected interference scenario, wherein the output signal with the applied gain is used as the processor output signal.

2. The system of claim 1, wherein the at least one processor is further caused to:

select the desired-source scenario based on sensor input signals and quantitative predefined scenario descriptions.

3. The system of claim 1, wherein the at least one processor is further caused to:

select the interference scenario based on sensor input signals and quantitative predefined scenario descriptions.

4. The system of claim 2, wherein the quantitative predefined scenario descriptions are covariance matrices.

5. The system of claim 3, wherein the quantitative predefined scenario descriptions are covariance matrices.

6. The system of claim 1, wherein the set of predefined interference scenarios include at least one interference scenario and a reflection of the at least one interference scenario around 0 degrees.

7. The system of claim 2, wherein the set of predefined desired-source scenarios represent angles over a range spanning a desired beamwidth.

8. The system of claim 1, wherein the at least one processor is further caused to:

select the desired-source scenario based on sensor input signals and adaptable predefined scenario descriptions.

9. The system of claim 1, wherein the at least one processor is further caused to:

select the interference scenario based on sensor input signals and adaptable predefined scenario descriptions.

10. The system of claim 8, wherein the adaptable predefined scenario descriptions are covariance matrices.

11. The system of claim 9, wherein the adaptable predefined scenario descriptions are covariance matrices.

12. A computer-implemented method comprising:

for one or more coefficients characterizing an output signal:

selecting a desired-source scenario from a set of predefined desired-source scenarios;

selecting an interference scenario from a set of predefined interference scenarios; and applying a gain to the output signal based on the selected desired-source scenario and the selected interference scenario, wherein the desired-source scenario is selected to maximize the amplitude of the output signal and the interference scenario is selected to minimize the amplitude of the output signal, based on sensor input signals and quantitative predefined scenario descriptions, and wherein the output signal with the applied gain is used as the processor output signal.

13. The method of claim 12, wherein the desired-source scenario is selected to maximize the amplitude of the output signal based on sensor input signals and adaptable predefined scenario descriptions.

14. The method of claim 12, wherein the interference scenario is selected to minimize the amplitude of the output signal based on sensor input signals and adaptable predefined scenario descriptions.

15. The method of claim 12, wherein the quantitative predefined scenario descriptions are covariance matrices.

16. The method of claim 13, wherein the adaptable predefined scenario descriptions are covariance matrices.

17. The method of claim 14, wherein the adaptable predefined scenario descriptions are covariance matrices.

18. A system comprising:

at least one processor; and a computer-readable medium coupled to the at least one processor having instructions stored thereon which, when executed by the at least one processor, causes the at least one processor to, for one or more coefficients characterizing an output signal:

combine a plurality of numbers, each number being a gain associated with a unique pair of a desired-source scenario selected from a set of predefined desired-source scenarios, and an interference scenario selected from a set of predefined interference scenarios, wherein the plurality of numbers are combined such that the resulting number approaches a largest desired-source scenario number and a smallest interference scenario number, and wherein the resulting number is used to multiply said coefficients to render new coefficients characterizing a new output signal.

19. The system of claim 18, wherein the at least one processor is further caused to:

mask interference of the desired source signal based on the combined plurality of numbers.

20. A system comprising:

at least one processor; and a computer-readable medium coupled to the at least one processor having instructions stored thereon which, when executed by the at least one processor, causes the at least one processor to:

multiply a time-frequency coefficient that forms a component of a representation of a beamformer output signal or a single microphone output signal by a real number that minimizes the squared difference between a resulting scaled coefficient and a desired-source signal; and adjust the desired-source signal to compensate for the desired-source signal traveling from a location of the source to a location of the beamformer or the single microphone.

21. The system of claim 20, wherein the adjustment to the desired-source signal is further based on compensating for successive processing by the beamformer.

22. The system of claim 20, wherein the at least one processor is further caused to:

limit a computed gain to be between 0 and 1.

23. The system of claim 22, wherein the limited gain is computed using $$g^* = \frac{1 - \min\left(\alpha, \frac{\|\bar{R}_\psi\|_w}{\|\bar{R}_\psi\|_M} \frac{1}{\|\bar{R}_M\|_w}\right)}{1 - \min\left(\alpha, \frac{\|\bar{R}_\psi\|_w}{\|\bar{R}_\psi\|_M} \frac{\|\bar{R}_\xi\|_M}{\|\bar{R}_\xi\|_w}\right)},$$

with a set to $\alpha$ value between 0.9 and 1.0.

* * * * *